United States Patent [19]

Nystad

[11] 4,094,025

[45] June 13, 1978

[54] WATER MATTRESS

[76] Inventor: Jan Nystad, Amundsvingen 16, 5095 Ulset, Norway

[21] Appl. No.: 704,556

[22] Filed: July 12, 1976

[30] Foreign Application Priority Data

Jul. 30, 1975 Norway ..... 752682

[51] Int. Cl.[2] ..... A47C 27/08

[52] U.S. Cl. ..... 5/365; 5/370

[58] Field of Search ..... 5/365, 370, 371, DIG. 2

[56] References Cited

U.S. PATENT DOCUMENTS

| | | | |
|---|---|---|---|
| 489,517 | 1/1893 | Woods | 5/370 X |
| 1,943,888 | 1/1934 | Ewald | 5/370 |
| 3,108,293 | 10/1963 | King | 5/370 |
| 3,456,270 | 7/1969 | Weinstein et al. | 5/365 |
| 3,803,647 | 4/1974 | Reswick | 5/365 |

*Primary Examiner*—Robert L. Wolfe
*Assistant Examiner*—Victor N. Sakran
*Attorney, Agent, or Firm*—Cushman, Darby & Cushman

[57] ABSTRACT

A water mattress which can be adjusted to all intermediate degrees of softness between hard and completely soft. The water mattress consisting of water container, open upwards and with a bottom shaped to contain a minimum of water. A flexible elastic watertight cover fastened watertightly to the side walls of the container and a flexible raising and lowering supporting arrangement placed inside said container and an inflatable air-mattress placed between said supporting arrangement and the upper cover. The raising and lowering operation and inflation operation being controlled from outside said container.

2 Claims, 1 Drawing Figure

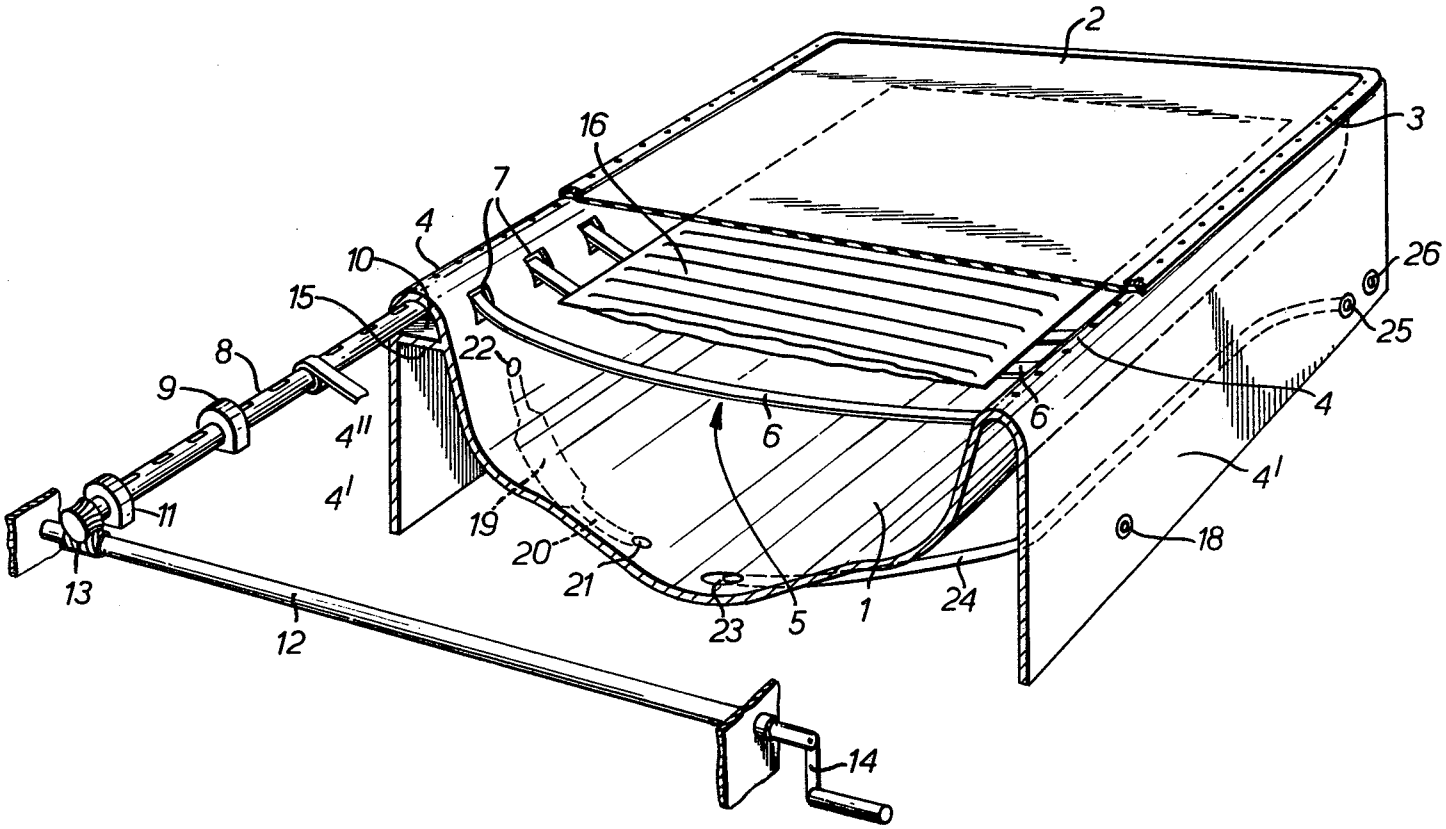
2
3
26
25
4
4'
18
6
24
1
14
5
6
23
16
21
20
7
22
19
4
10
4''
4'
15
12
8
9
11
13

WATER MATTRESS

The present invention as stated in the introduction to the following main claim, relates to a water mattress which is intended for patients lying for a long time in the same position and therefore prone to get bed sores.

It is generally known that patients who are confined to bed and lie on traditional types of mattresses made of fairly firm materials, are exposed to greater pressure against the skin on those parts of the body which are pressed down into the mattress than on other parts of the body. Both patients who lie for a length of time in the same position as well as patients with poor blood circulation in their skin and muscles, are therefore particularly prone to get bed sores on their shoulders, elbows, seat, hips and other places which bear down against and are pressed down into the mattress. Bed sores of this type heal slowly and cause unnecessary suffering, prolong stay in hospital and entail the use of expensive hormone salves etc.

A number of different mattresses are known and used with lying foundations intended to prevent and to facilitate as well the healing of bed sores, and the most effective seem to be the so-called water beds or water mattresses where the disadvantages of ordinary mattresses and bed supports are eliminated. The principle of the known water beds or water mattresses, is based on the concept of buoyancy and the relatively even distribution of pressure on a body which is lowered into the water. When the container is filled with water to such a height that the upper cover is supported by water, a patient lying the upper covering which can consist of a soft, insulating material, will actually have the feeling of floating in water as the upper covering follows the lines of the body, and regardless less of his position, whether lying or sitting, the pressure will be distributed evenly over that part of the surface of the body which is in contact with the upper covering of the mattress. Extremities of the body, as described earlier, are thereby not subjected to too much pressure, and bed sores can thereby be easily prevented. When the water mattress is used, a felt blanket and ordinary bedding can of course be used on top of the mattress cover.

When attending to bedridden patients it is practical that the mattress is hard, i.e., that it does not take the shape of the patient and also since a firm foundation is necessary for various treatments of the patient, as e.g. for exterior heart compression when the heart beat ceases. In order to make the mattress hard in a very short time, a raising and lowering supporting device is known to be built in, in the shape of a platform which is manoeuverable from the outer side of the container. In order to make the mattress hard, the supporting device is raised up under the upper cover so that the floating effect of the water mattress is annulled. In addition it is known to lay in for instance a soft foam plastic layer between the platform and the cover of the mattress in order to soften the effect of the stiff platform surface. With the foam plastic layer mentioned between the platform and the mattress cover, no appreciable variation in the degree of softness is obtained between a firm under layer with a raised platform and a completely soft under layer with a lowered platform where the foam plastic layer has no effect as it lies on the platform.

It has been proven with the known water-beds or water mattress which are also preferably equipped with built-in thermostat and possibly heating elements for regulating the temperature of the water, that the patient can only lie on these for shorter periods because the patient has difficulty in adjusting to this soft foundation. The patient feels uncomfortable and has to be moved over into a bed with an ordinary mattress after a certain time, to "stabilize" himself. In other words, patients cannot lie in water beds of this type over a longer period of time, and this moving of the patients entails extra work for the nursing personnel and unnecessary exertion for the patients. For the latter and previously mentioned reasons the water bed in practice is only used as a means of treatment and not for any prolonged lying in bed.

There is a need for intermediate degrees of softness in the water-bed between completely hard and completely soft so that the patient gradually can adjust to the soft under layer. In order to obtain a certain adjustment of the under layer, it is known to construct the upper cover of the mattress as an air mattress in which the air pressure can be regulated. When the air mattress which forms the cover of the mattress is pumped up, the foundation will be harder, but not as hard and firm as when the previously mentioned raising and lowering platform is used. By reducing the air pressure in the mattress the hardness can be regulated right down to a completely soft support.

The disadvantages with the first-mentioned device with a raising and lowering platform with possibly a foam plastic layer placed on the latter, and the last-mentioned arrangement whereby the cover itself is shaped like an air mattress is which the air pressure can be regulated, are as follows: The first arrangement cannot be regulated to intermediate degrees of softness between a firm foundation and a completely soft foundation. The other arrangement cannot form a completely firm foundation which is practical for attending or bedridden patients or for different treatments of patients as mentioned before.

The purpose with the present invention is to provide a water mattress which can be adjusted to all intermediate degrees of softness between hard and completely soft and this is achieved according to the invention by supporting device being flexible, that the flexible, water-proof cover of the mattress is elastic, and that between the supporting device and the cover of the mattress is placed an inflatable air mattress.

The air mattress rests freely in the water mattress between the supporting device and the mattress cover and is connected by means of a tube and a valve with the outer wall of the container where it can be connected to suitable pumping-up equipment for adjustable pumping up of the air mattress. When the air mattress is pumped up, it floats up in the water and supports the flexible, elastic cover of the mattress and an extra buoyancy is obtained which effects a firmer foundation for the patient without the even distribution of pressure on the patient's body being appreciably reduced. By varying the volume of the air mattress by means of pumping up, the degree of softness in the water mattress can be adjusted according to the needs of the patient.

By raising or lowering the flexible supporting device under the blown-up air mattress, and as well possibly by regulating the air pressure of the air mattress, the water mattress'es softness can be adjusted from an entirely soft foundation to an entirely firm foundation. An entirely firm foundation is achieved with the flexible supporting device in a completely raised position and with the air mattress not pumped up. The softest foundation is obtained with the supporting device lowered and the air mattress empty.

In addition to the above-mentioned advantages, advantages are also obtained which are known from previously known water mattresses, e.g. that the air mattress can be used to lift a heavy patient so that the patient does not sink too deeply down into the container of the water mattress when he is in a sitting position. The depth of the container can thereby be reduced considerably in relation to a water mattresses without air mattress. This reduced depth has the effect, known per se that the water container can be made more shallow, and this together with the shaping of the bottom of the container in length and breadth so that it approximately corresponds to a person's posterior longitudinal and transverse contours in lying position, reduces the amount of water and thereby the weight of the mattress as is known per se in relation to water mattresses where the container itself has the shape of an upward open rectangular box without any special shaping of the bottom of the container. By means of the special shaping of the bottom of the water container as mentioned above, considerable saving in weight is achieved in relation to the conventional water mattress, and a water mattress according to the present invention with equipment will in operational condition weigh approximately 300 kg. including water.

The characteristic features of the invention will moreover be evident from the following claims and an embodiment of the invention will be described as follows with reference to an embodiment roughly shown in the drawing where the only FIGURE shows a schematic sketch of the water mattress in perspective and in cross-section.

The water mattress as shown in the drawing comprises a container in reinforced polyester plastic preferably cast in glass fiber with a covering 2 preferably a 6 mm thick nylon reinforced, elastic rubber material such as in used in diving suits, fastened water-tight and detachably to the container at the upper edge by means 4 of a strip 3 fastened to the edge of the container by means of screws.

The water mattress is in addition equipped with a raising and lowering foundation arrangement 5 which in the embodiment shown consists of a number of parallel straps 6 running transversely to the one longitudinal side of the container 1 by means of a fastening arrangement (not shown) which makes both tightening and adjusting the straps possible. The other end of the straps goes through hole 7 on the other longitudinal side of the container and is fastened to a shaft 8 which extends along the said longitudinal side and is pivotally mounted at 9 in a closed duct 10 under the upper edge 4 of the container. The one end of the shaft 8 protrudes from the one end of the said duct through a sealing sleeve 11 and is connected with a shaft 12 running transversely to the container 1 by means of a worm gear 13. The shaft is pivotally mounted at the one end of the container 1 and is equipped with a crank 14.

By turning the shaft 12 by means of the crank 14 and thereby the shaft 8, the straps 6 can be tightened or loosened to obtain a hard or a soft mattress. The worm gear has so great a ratio that the friction in the endless screw itself and the mountings for the shafts 8 and 12 are sufficient to lock the straps 6 in the desired position without using any special locking mechanism. Because of the special construction of the container 1, as can be seen from the drawing and which will be discussed more in detail below, the side walls are so rigid that these do not give way when the straps 6 are weighed down in a taut condition.

The container 1 is shaped like an elongated trough with side walls which run from the bottom upwards toward the side edges 4 of the container which are extended and curved downward in such a way that vertically running outer side walls 4' are formed which are connected with each other at the corners of the container 1. The previously discussed duct 10 for the shaft 8 under the upper edge 4 of the container 1, has thereby a natural placement between the outer wall 4' and the inner wall 4' of the container as these are connected with each other by means of a longitudinal web 15 which forms the bottom of the duct. In the same way, the transverse shaft 12 is mounted between the inner and outer end wall of the container where there, however, is no need for any water-tight duct as the shaft 12 has no connection with the container's 1 water filled space.

In order to achieve still more adjustment in the degree of softness of the water mattress, as mentioned introductorily, an air mattress 16 is laid in between the straps 6 and the upper cover 2 of the mattress. The air mattress can be of soft plastic with transverse air ducts and should cover almost the entire lying surface of the water mattress. The air mattress is connected by means of a tube (not shown) with a speed connection 18 arranged on the outer wall 4' on the one longitudinal side of the container 1.

The air mattress 16 can be pumped up with air either from a central air pressure installation, gas bottle, foot pump or from a small transportable, motorized compressor which can eventually be built in under the mattress together with a possible water pump. When the air mattress 16 is deflated, it sinks down and lies along the bottom of the container 1 on the slack straps 6. When the straps are tightened in order to obtain thereby a firm, hard resting surface on the water mattress, the air mattress 16 in deflated state will lie on the tight straps 6 and even out the spaces between the straps.

By pumping up the air mattress 16 when the straps 6 are slack, it will float up in the water and support the upper cover 2 of the water mattress. By varying the air pressure and thereby the volume in the air mattress, the buoyancy can be regulated and thereby the support of the upper cover 2 for varying the degree of softness of the water mattress.

By tightening the straps 6 under the air mattress 16 in inflated state, approximately the same effect is obtained in the water mattress as obtained with a foam rubber mattress on the ordinary hard bottom of a bed.

Thus, by means of the loosely inserted inflatable air mattress 16 in combination with a raising and lowering support arrangement 5, the lying surface of the water mattress can be adjusted to any desired degree of softness, i.e., a completely "floating state" i.e., where the patient lies on the upper cover 2 of the water mattress, solely supported by the water in the container 1, to an entirely firm state where the upper cover 2 is supported by completely tightened straps 6 without any air in the air mattress 16 lying in between. The intermediate degrees of softness are obtained as mentioned previously by a combination between the air pressure in the air mattress 16 and tightening of the straps 6 by means of a tightening device comprising the shaft 8, 12 and the crank 14. The water mattress with outer measurements corresponding to an ordinary hospital bed, can be placed in the frame of the latter and can be used as an ordinary bed and as a special bed for all the different operations to be undertaken with a bedridden patient in connection with care and tending and treatment of the patient.

The mattress can e.g. also be used for massage of musculature, as experiments have shown the vigorous wave formation can be achieved in the resting surface of the water mattress by striking the upper cover 2 at e.g. the foot of the water mattress. The waves caused in the water spread along the resting surface of the water mattress all the way to the head of the bed and effect vigourous massage of the patient's muscles which are in contact with the upper cover 2. This can be very useful for patients with poor blood circulation in their skin and musculature, and especially in their legs. This in itself should help a great deal to prevent bed-sores.

The water mattress may in addition be equipped with e.g. thermostatic-controlled heating elements and a circulation pump to maintain the desired temperature in the resting surface of the water mattress. This is roughly shown in the drawing with a thermostat-controlled heating element 19 arranged in a conduit or pipe 20 which runs between the openings 21 and 22 at the bottom and inner side wall respectively of the container 1 in order thereby to obtain a thermo-syphon effect.

The container 1 is in addition equipped with a drain 23 which via a pipe 24 is connected with a coupling 25 in the container's 1 side wall where also a coupling 26 for water supply is arranged. The latter is by means of a pipe-line (not shown) connected with an inlet opening (not shown) in the container 1.

By pumping water out of the container 1 without allowing air to slip into the latter, the upper cover 2 which can consist of an elastic rubber cloth, takes the shape of the container's 1 inner wall when in addition the straps 6 are entirely slack, thereby an upward, open container is formed which can be lined with plastic foil. This container can thereby be used as a bathtub for the patient.

Having described my invention, I claim:

1. In a water mattress assembly, a container having a bottom and upright side walls and an open top and a length and breadth to receive a patient, an elastic, flexible water-tight cover sealed to the side walls and closing the open top of the container to form a water space, a water inlet and a water outlet connected with the water space, a supporting arrangement mounted in the water space for vertical movement toward and away from the cover, the supporting arrangement being essentially coextensive with the cover so that in a raised position the arrangement supports the cover to render the same hard, said supporting arrangement including a plurality of parallel spaced-apart straps extending transversely across the container an inflatable floatable air mattress disposed in the water space between the supporting arrangement and the cover and essentially coextensive with the supporting arrangement and the cover, means maneuverable from outside the container for raising and lowering the supporting arrangement, said means including means for tightening and loosening the straps, whereby upon loosening the straps and inflating the air mattress the latter floats up into engagement with the cover and upon tightening the straps and deflating the air mattress the latter lies on the straps and evens out the spaces between the latter, and means controllable from outside the container for adjusting the degree of inflation of the air mattress, whereby the hardness of the cover may be adjusted between wide limits by varying the vertical position of the supporting arrangement and by varying the degree of inflation of the air mattress.

2. A water mattress assembly as in claim 1 wherein the tightening and loosening means includes a rotatable shaft extending longitudinally of the container, each of said straps having an end connected to said shaft.

* * * * *